US009462397B2

(12) United States Patent
Neumeyer et al.

(10) Patent No.: US 9,462,397 B2
(45) **Date of Patent: *Oct. 4, 2016**

(54) HEARING AID WITH AUTOMATIC MODE CHANGE CAPABILITIES

(71) Applicant: III Holdings 4, LLC, Wilmington, DE (US)

(72) Inventors: Frederick Charles Neumeyer, Austin, TX (US); John Michael Page Knox, Austin, TX (US); Gregory Charles Yancey, Austin, TX (US)

(73) Assignee: III Holdings 4, LLC, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/935,744

(22) Filed: Jul. 5, 2013

(65) Prior Publication Data

US 2013/0301860 A1 Nov. 14, 2013

Related U.S. Application Data

(63) Continuation of application No. 13/244,260, filed on Sep. 23, 2011, now Pat. No. 8,515,110.

(60) Provisional application No. 61/388,349, filed on Sep. 30, 2010.

(51) Int. Cl.
*H04R 25/00* (2006.01)

(52) U.S. Cl.
CPC ..... *H04R 25/65* (2013.01); *H04R 25/50* (2013.01)

(58) Field of Classification Search
CPC ..... H04R 25/50; H04R 25/65
USPC ..... 381/23.1, 312, 314, 322, 323, 330, 381
See application file for complete search history.

(56) References Cited

U.S. PATENT DOCUMENTS

| | | | |
|---|---|---|---|
| 4,845,755 | A | 7/1989 | Busch et al. |
| 5,107,473 | A | 4/1992 | Fuji et al. |
| 5,303,306 | A | 4/1994 | Brillhart et al. |
| 5,524,150 | A | 6/1996 | Sauer |
| 5,608,803 | A | 3/1997 | Magotra et al. |
| 5,651,073 | A | 7/1997 | Isu et al. |
| 5,721,783 | A | 2/1998 | Anderson |
| 5,727,070 | A | 3/1998 | Coninx |

(Continued)

FOREIGN PATENT DOCUMENTS

| | | |
|---|---|---|
| WO | 2011159349 | 12/2011 |

OTHER PUBLICATIONS

United States Patent and Trademark Office, Non-Final Office Action, U.S. Appl. No. 13/290,269, mailed Feb. 1, 2016, 28 pages.

(Continued)

*Primary Examiner* — Tuan D Nguyen
(74) *Attorney, Agent, or Firm* — Perkins Coie LLP

(57) ABSTRACT

A hearing aid includes a casing configured to fit behind an ear of a user's head and against a side of the user's head. The hearing aid further includes a first proximity sensor associated with the casing and configured to generate a first signal that is proportional to a proximity of the casing to the ear and includes a processor coupled to the first proximity sensor and configured to select an operating mode from a plurality of operating modes in response to the first signal.

8 Claims, 4 Drawing Sheets

(56) References Cited

U.S. PATENT DOCUMENTS

| | | | | |
|---|---|---|---|---|
| 5,734,976 | A | 3/1998 | Bartschi et al. | |
| 5,873,126 | A | 2/1999 | Singh et al. | |
| 6,078,675 | A | 6/2000 | Bowen-Nielsen et al. | |
| 6,151,400 | A | 11/2000 | Seligman | |
| 6,330,339 | B1 | 12/2001 | Ishige et al. | |
| 6,532,294 | B1 | 3/2003 | Rudell | |
| 6,794,852 | B2 | 9/2004 | Tran | |
| 6,920,229 | B2 | 7/2005 | Boesen et al. | |
| 7,010,133 | B2 | 3/2006 | Chalupper et al. | |
| 7,167,571 | B2 | 1/2007 | Bantz et al. | |
| 7,301,305 | B2 | 11/2007 | Tran | |
| 7,324,650 | B2 | 1/2008 | Fischer et al. | |
| 7,397,217 | B2 | 7/2008 | Van Brocklin et al. | |
| 7,446,505 | B2 | 11/2008 | Paul et al. | |
| 7,451,256 | B2 | 11/2008 | Hagen et al. | |
| 7,499,686 | B2 | 3/2009 | Sinclair et al. | |
| 7,529,545 | B2 | 5/2009 | Rader et al. | |
| 7,561,708 | B2 * | 7/2009 | Rohrlein | 381/315 |
| 7,610,035 | B2 | 10/2009 | Van Bosch et al. | |
| 7,676,335 | B2 | 3/2010 | Ahmed et al. | |
| 7,715,576 | B2 | 5/2010 | Ribic et al. | |
| 7,778,432 | B2 | 8/2010 | Larsen et al. | |
| 7,787,647 | B2 | 8/2010 | Hagen et al. | |
| 7,826,631 | B2 | 11/2010 | Fischer et al. | |
| 7,853,028 | B2 | 12/2010 | Fischer et al. | |
| 8,265,315 | B2 | 9/2012 | Sørensen et al. | |
| 8,761,421 | B2 | 6/2014 | Apfel et al. | |
| 9,071,917 | B2 | 6/2015 | Apfel | |
| 9,167,339 | B2 | 10/2015 | Knox et al. | |
| 2003/0069704 | A1 | 4/2003 | Bean et al. | |
| 2005/0277994 | A1 | 12/2005 | McNamee et al. | |
| 2005/0281424 | A1 | 12/2005 | Rass et al. | |
| 2006/0198530 | A1 | 9/2006 | Fischer et al. | |
| 2007/0014423 | A1 * | 1/2007 | Darbut et al. | 381/330 |
| 2007/0214893 | A1 | 9/2007 | Killion et al. | |
| 2007/0255435 | A1 * | 11/2007 | Cohen et al. | 700/94 |
| 2007/0274531 | A1 | 11/2007 | Camp et al. | |
| 2008/0037797 | A1 | 2/2008 | Goldstein et al. | |
| 2008/0136654 | A1 | 6/2008 | Toriello et al. | |
| 2008/0137873 | A1 | 6/2008 | Goldstein et al. | |
| 2008/0167531 | A1 | 7/2008 | McDermott et al. | |
| 2008/0240477 | A1 | 10/2008 | Howard et al. | |
| 2009/0074216 | A1 | 3/2009 | Bradford et al. | |
| 2009/0208024 | A1 | 8/2009 | Farver et al. | |
| 2009/0262964 | A1 | 10/2009 | Havenith et al. | |
| 2009/0290721 | A1 | 11/2009 | Goldstein et al. | |
| 2010/0054511 | A1 | 3/2010 | Wu et al. | |
| 2010/0202637 | A1 | 8/2010 | Cornelisse et al. | |
| 2010/0296668 | A1 | 11/2010 | Lee et al. | |
| 2011/0176697 | A1 | 7/2011 | Apfel et al. | |
| 2011/0200215 | A1 | 8/2011 | Apfel et al. | |
| 2011/0243345 | A1 | 10/2011 | Carreras et al. | |
| 2011/0249836 | A1 | 10/2011 | Solum et al. | |
| 2012/0082329 | A1 | 4/2012 | Neumeyer et al. | |
| 2012/0130660 | A1 | 5/2012 | Neumeyer et al. | |
| 2014/0003641 | A1 | 1/2014 | Neumeyer et al. | |
| 2015/0256946 | A1 | 9/2015 | Neumeyer et al. | |

OTHER PUBLICATIONS

United States Patent and Trademark Office, Non-Final Office Action, U.S. Appl. No. 14/719,544, mailed Mar. 28, 2016, 5 pages.
Berger, Elliott, "Dangerous Decibels: How Loud is Too Loud?" <www.dangerousdecibels.org/education/information-center/decibel-exposure-time-guidelines/>, accessed Dec. 23, 2013, 3 pages.
United States Patent and Trademark Office, Final Office Action, U.S. Appl. No. 13/007,568, mailed May 30, 2013, 19 pages.
United States Patent and Trademark Office, Final Office Action, U.S. Appl. No. 13/176,738, mailed May 22, 2014, 11 pages.
United States Patent and Trademark Office, Final Office Action, U.S. Appl. No. 13/290,269, mailed May 1, 2015, 23 pages.
United States Patent and Trademark Office, Final Office Action, U.S. Appl. No. 13/708,009, mailed Jul. 30, 2014, 9 pages.
International Searching Authority/United States, International Search Report and Written Opinion, PCT Patent Application PCT/US2011/001077, mailed Nov. 15, 2011, 9 pages.
United States Patent and Trademark Office, Non-Final Office Action, U.S. Appl. No. 13/007,568, mailed Dec. 12, 2012, 19 pages.
United States Patent and Trademark Office, Non-Final Office Action, U.S. Appl. No. 13/176,738, mailed Feb. 18, 2015, 5 pages.
United States Patent and Trademark Office, Non-Final Office Action, U.S. Appl. No. 13/176,738, mailed Jan. 16, 2014, 13 pages.
United States Patent and Trademark Office, Non-Final Office Action, U.S. Appl. No. 13/176,738, mailed Jul. 18, 2013, 16 pages.
United States Patent and Trademark Office, Non-Final Office Action, U.S. Appl. No. 13/290,269, mailed Nov. 18, 2014, 20 pages.
United States Patent and Trademark Office, Non-Final Office Action, U.S. Appl. No. 13/708,009, mailed Jan. 21, 2014, 7 pages.
United States Patent and Trademark Office, Notice of Allowance, U.S. Appl. No. 13/007,568, mailed Feb. 14, 2014, 5 pages.
United States Patent and Trademark Office, Notice of Allowance, U.S. Appl. No. 13/176,738, mailed Jun. 17, 2015, 9 pages.
United States Patent and Trademark Office, Notice of Allowance, U.S. Appl. No. 13/244,260, mailed May 1, 2013, 12 pages.
United States Patent and Trademark Office, Notice of Allowance, U.S. Appl. No. 13/708,009, mailed Feb. 27, 2015, 5 pages.
GN ReSound Group, USA. ReSound Alera: User Brochure. Instructional brochure M101100-GB-10.02 Rev.A, 2010, 7 pages.
United States Patent and Trademark Office, Restriction Requirement, U.S. Appl. No. 13/708,009, mailed Nov. 28, 2014, 5 pages.
United States Patent and Trademark Office, Restriction Requirement, U.S. Appl. No. 14/719,544, mailed Aug, 27, 2015, 5 pages.

* cited by examiner

HEARING AID WITH AUTOMATIC MODE CHANGE CAPABILITIES

CROSS REFERENCE TO RELATED APPLICATION(S)

This application is a continuation of, and claims priority to U.S. patent application Ser. No. 13/244,260, entitled "HEARING AID WITH AUTOMATIC MODE CHANGE CAPABILITIES," filed on Sep. 23, 2011 (now U.S. Pat. No. 8,515,110), which is a non-provisional application of and claims priority to U.S. Provisional Patent Application No. 61/388,349 filed on Sep. 30, 2010 and entitled "HEARING AID WITH AUTO MODE CHANGE CAPABILITIES." The foregoing patent and applications are incorporated herein by reference in their entireties.

FIELD

This disclosure relates generally to hearing aids, and more particularly to hearing aids having different modes and automatic mode change functionality.

BACKGROUND

Hearing aids are often designed to change states (on and off) and modes (sleep mode, normal mode, phone mode, and other known modes) as necessary. Various methods of changing states and modes have been developed. The most common method includes manual switches for turning the hearing aid on/off. While manual switches are simple to use, such switches typically offer only binary state options, such as on/off. The manual switch requires the user to remember to turn off the hearing aid at night. Failure by the user to do so can result in battery charge losses of up 50% of the total battery life. Additionally, a mechanical switch potentially exposes the internal circuitry of the hearing aid to the elements, including contaminants such as water, and provides the hearing aid with a point of potential failure.

Another more elaborate method uses algorithms that monitor the sound conditions and change modes depending on the type/amount of noise in the user's environment. However, using a software solution to determine the state/operating mode of the hearing aid requires substantial programming and software development, generates additional strain and wear on the processor and microphone, and often requires a large portion of the circuitry to remain on during the off/sleep mode in order to wake the hearing aid later, unnecessarily depleting the battery.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

In a behind-the-ear hearing aid, the casings of the hearing aids are designed to fit comfortably behind one of the user's ear. For example, a hearing aid designed to fit behind a right ear may be a mirror opposite (in terms of the shape of the casing) relative to a hearing aid designed to fit behind a left ear. Hearing aids are often sold in pairs, and the user is expected to select the correct hearing aid for the correct ear. Unfortunately, the differences between the hearing aid casings can be subtle and, particularly for new users, incorrect selection of the proper hearing aid adds to the overall difficulty of adjusting to wearing hearing aids. Moreover, from a manufacturing perspective, providing two different casings (specifically for the right ear and the left ear) adds to the design cost and increases the manufacturing costs.

Embodiments of a hearing aid are described below that can be worn by a user interchangeably on either of the user's ears. The hearing aid includes one or more proximity sensors configured to detect the proximity of the user's ear or side of the head relative to the casing of the hearing aid and processing logic to determine operational states and modes of the hearing aid processor in response to detecting the proximity. In particular, one or more proximity sensors can be used to determine when the hearing aid is attached to a user's ear, and the hearing aid can be configured to transition from an off-state to an on-state based on this determination. Further, others of the one or more sensors can be used to detect the side of the user's head to determine which ear the hearing aid is attached to, and the hearing aid can be configured to select, for example, an appropriate mode (right ear/left ear) in response thereto or to select a low power or power off mode in response to detecting that the hearing aid has been removed from the user's ear.

Further, these sensors can be configured to detect proximity of a mobile phone, and the hearing aid may be configured to enter a phone mode in response thereto. In general, the casing configured to fit either ear and the associated circuitry operates to automatically configure the hearing aid for operation with respect to the ear to which the hearing aid is attached, thereby reducing manufacturing, programming, and development costs and increasing the flexibility and ease of use for the user. At the same time, replacing the manual on/off switches with an automatic mode detection system improves system reliability, improves the hearing aid's resistance to dust and water, and reduces wear and tear on the hearing aid. An example of a hearing aid is described with respect to FIG. 1 that is configured for automatic mode changes based on proximity detection.

Figure 1:
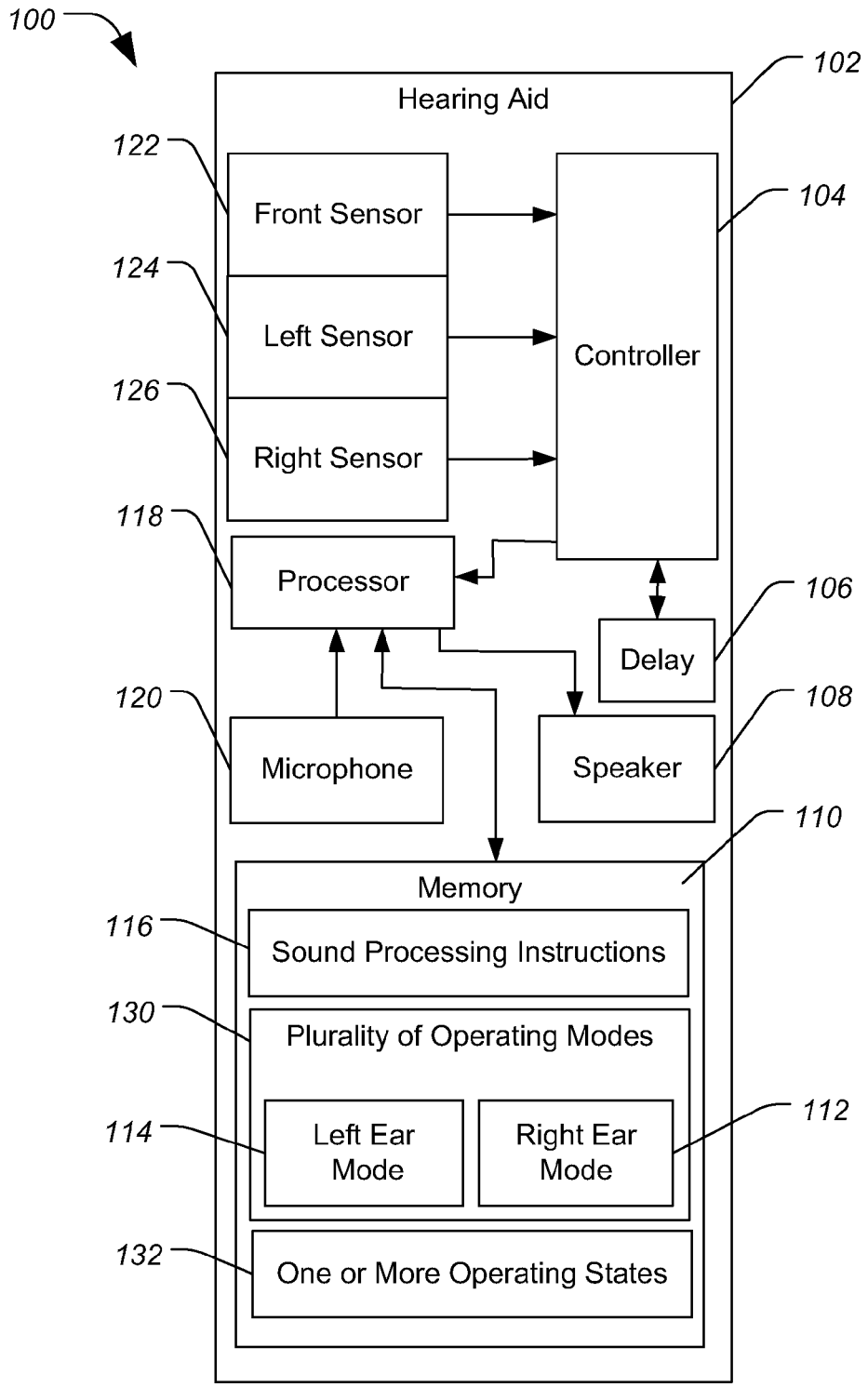
FIG. 1 is a block diagram of an embodiment of a hearing aid including a sensor for detecting a proximity that can be used to initiate automatic mode and state changes.

FIG. 1 is a block diagram of an embodiment of a hearing aid 100 including sensors 122, 124, and 126, each of which is configured to sense a proximity and to provide a signal proportional the proximity to a controller 104, which is configured to initiate automatic mode and state changes in response to the signals. Hearing aid 100 includes a casing 102, which defines an enclosure for securing circuitry and which is configured to be worn behind the user's ear. The casing 102 is symmetrical and is designed to fit behind either ear. Casing 102 has a left surface designed to fit against the right side of the user's head, a right surface designed to fit against the left side of the user's head, and a front surface curved to fit against the back of the user's ear.

Hearing aid 100 includes a front sensor 122 configured to detect a proximity of an object, such as the user's ear, relative to hearing aid 100. Front sensor 122 is located on a concave-curved portion shaped to fit the back of the user's ear on a front portion of casing 102, such that the proximity is detected when the casing 102 is placed against the curvature of the back of the user's ear. Hearing aid 100 further includes a left sensor 124 located at or adjacent to a surface of the left side of the casing 102 and configured to detect proximity of the user's head relative to the left side of the hearing aid 100. Hearing aid 100 also includes right sensor 126 located at or adjacent to a surface of the right side of the casing 102 and configured to detect a proximity of the user's head relative to the right side of the hearing aid 100. Sensors 122, 124, and 126 can include various types of proximity sensors, alone or in combination, that are configured to detect proximity of an object. Alternatively, sensors 122, 124, and 126 may include temperature sensors, pressure sensors, light sensors, capacitance sensors, or other known types of sensors.

Hearing aid 100 further includes a controller 104 a first input connected an output of front sensor 122, a second input connected to an output of left sensor 124, and a third input connected to an output of right sensor. Controller 124 further includes an output connected to an input of a processor 118 and an input/output connected to a delay circuit 106.

Processor 118 includes an input coupled to a microphone 120, an output coupled to a speaker 108, and an input/output coupled to a memory 110. Hearing aid 100 may further include an analog-to-digital converter including an input connected to the output of microphone 120 and an output connected to the input of processor 118. Further, hearing aid 100 may include a digital-to-analog converter including an input connected to the output of processor 108 and an output connected to the input of speaker 108.

Memory 110 includes processor-executable instructions that, when executed by processor 118, cause the processor 118 to determine at least one of a plurality of operating modes 130, such as right ear mode 112, left ear mode 114, ideal (or optimal) mode, sleep mode, a power off mode, and other modes. Memory 110 further includes processor-executable instructions that, when executed by processor 118, cause processor to determine an operating state of hearing aid 100 from the one or more states 132. Processor 118 executes instructions to determine the state of hearing aid 100 from the one or more states 132 and to select an operating mode from the plurality of operating modes 130 in response to determining the state.

In operation, each of the front sensor 122, the left sensor 124, and the right sensor 126 generates a proximity signal that is proportional to proximity of an object to the respective sensor. Controller 104 monitors the signals from sensors 122, 124, and 126 and determines if a state/mode change to the hearing aid should be made. In particular, the controller 104 monitors the signals to detect a change that exceeds a threshold. In a particular example, the controller 104 compares a difference between a ratio of the signals and a previous ratio (stored in a volatile memory (not shown) of controller 104) to a threshold to determine when a change is significant enough to warrant a state/mode adjustment. In response to detecting a change that exceeds the threshold, controller 104 provides a mode change signal to processor 118 to cause the processor 118 to execute the operating states instructions 132 to determine the state of hearing aid 100 and to execute operating modes instructions 130 to select a suitable operating mode for the hearing aid 100.

Delay circuit 106 provides a timing or delay signal to controller 104 to delay the activation of hearing aid 100 to prevent mechanical feedback caused by introducing speaker 108 into the user's ear. In some instances, delay circuit 106 may also be used to control the controller 104 to provide a timing signal for monitoring the signal outputs of the sensors 122, 124, and 126. Memory 110 also includes sound-processing instructions 116 executable by processor 118 to shape sounds received at microphone 120 to produce modulated signals for reproduction by speaker 108 at within the user's ear.

In one example, hearing aid 100 is in an off state or a sleep state to conserve energy. When the user positions the casing 102 of the hearing aid 100 behind his ear, front sensor 122 detects a proximity to the user's ear and left sensor 124 or right sensor 126 detects a proximity to the user's head. Front sensor 122, left sensor 124, and right sensor 126 each produce output signals proportional to the proximity of the user's ear or head. If the user places hearing aid 100 on his right ear, left sensor 124 detects the proximity of the right side of the user's head that becomes relatively stable over time, whereas the right sensor 126 may detect a proximity based on the position of the user's hand relative to the right sensor 126 that is transient (as compared to the signal from the left sensor 124).

In an example, controller 104 receives input signals from front sensor 122, left sensor 124, and delay circuit 106, and provides a control signal to processor 118. In an example, in response to a signal from delay circuit 106, controller 104 waits a predetermined period before sending the control signal to processor 118 to give the user time to complete insertion of hearing aid 100 before providing modulated sound signals to speaker 108.

Processor 118 receives the control signal from controller 104, and in response to receiving the control signal, processor 118 changes the state of hearing aid 100 from an off-state to an on state, and applies a right ear operational mode to hearing aid 100 in response to determining that casing 102 is mounted to the user's right ear. After switching to the right ear operational mode, processor 118 executes one of the sound-processing (sound shaping) instructions 116 corresponding to the hearing deficit of the user's right ear to shape sound signals received from microphone 120 to generate modulated sound signals, and supply them to speaker 108 for reproduction to the user at or within the user's right ear.

While the above-discussion assumes placement within the right ear, it should be appreciated that, if the user places hearing aid 100 on his left ear, right sensor 126 and front sensor 122 detect respective proximities to the user's head and ear, respectively. In response to the proportional signals, the controller 104 and processor 118 cooperate to configure the hearing aid 100 to operate in a left ear mode 114, modulating the audio output signal to compensate for the user's hearing deficiency in his left ear.

In general, a user's hearing deficiency in one ear may differ from that of the user's other ear. Accordingly, in a conventional set of hearing aids, sound-shaping for one hearing aid may be different than that for the other. In this instance, however, the hearing aids can be picked up by the user and worn on either ear, and the hearing aid 100 automatically adapts to the correct operating mode. If the hearing aid is placed in the right ear, sound shaping algorithms designed to compensate for the hearing deficiency in the right ear are applied, and vice versa.

In the illustrated embodiment, it is assumed that the plurality of operating modes 130 include sound shaping instructions associated with both the left and the right ear (identified as left ear mode 114 and right ear mode 112). Further, it should be appreciated that the left ear mode 114 may include multiple sound-shaping instructions for different operating environments. Similarly, the right ear mode 112 may include multiple sound shaping instructions for different operating environments. In a particular example, after determining the left/right ear position of hearing aid 100, processor 118 can be configured to select one of a plurality of sound-shaping algorithms associated with the operating mode (e.g., right ear mode 114) based on detected sound signals from microphone 120. In one instance, processor 118 detects a noisy background environment (such as a crowd, bar, etc.) and selects and applies sound-shaping instructions to filter out such background noise.

In a second example, hearing aid 100 is in an on state when the user removes it from his ear. In this example, front sensor 122, left sensor 124, and/or right sensor 126 detect respective changes in the proximity, when the hearing aid is removed, and produce proportional signals corresponding to the changes. Because at least two sensors detect a change in the proximity and produce such proportional signals indicating hearing aid 100 is no longer proximate to the user's ear, controller 104 provides a control signal to processor 118 to turn off sound processing and/or to enter into a low-power mode, because hearing aid 100 is no longer being worn by the user.

In an alternative embodiment, in response to controller 104 providing the control signal, processor 118 places hearing aid 100 in a sleep mode, a recharge mode, an idle mode, or another reduced power mode. In such a mode, processor 118 deactivates or reduces power to some of the circuitry within casing 102. In particular, processor 118 shuts itself down and leaves controller 104 active to wake up the processor 118 in response to detecting a proximity using front sensor 122. In an example, controller 104 can be implemented as a low-power logic circuit that consumes less power than processor 118. Thus, turning off the processor 118 and other circuitry, while allowing controller 104 to selectively control front sensor 122, left sensor 124, and right sensor 126 to monitor for proximity, conserves battery power, extending the battery life of hearing aid 100.

By providing a hearing aid that is configured to operate and fit on either of the user's ears, overall manufacturing, programming, and development costs are reduced because a single casing and associated circuitry can be produced that can fit interchangeably. Further, the interchangeability of the casing 102 improves the flexibility and ease of use for the user, making it easier for the user to adapt to wearing the hearing aid. At the same time, replacing the manual switch with an automatic on/off system improves reliability, reduces wear and tear, and improves usability for hearing aid 100.

In another example, left and right sensors 124 and 126 can also be positioned on casing 102 at a location that facilitates detection of the proximity of a phone in order to automatically detect the presence of the phone and to control the processor 118 to enter a phone mode. The phone mode may involve utilization of a Bluetooth transceiver, a telecoil or other circuitry within the hearing aid 102 for direct reception of the audio signal, instead of audible transmission by a speaker of the phone for capture by the microphone 120. Alternatively, the audio processing by processor 118 may be adjusted to increase volume, etc. If the user is wearing hearing aid 100 on their left ear, then right sensor 126 and front sensor 122 detect proximity of casing 102 relative to the user's head and ear, respectively. When a phone is placed against the user's left ear, left sensor 124 detects a proximity of the user's ear relative to the phone. In this instance, all three sensors 122, 124, and 126 detect a proximity, and controller 104 generates a control signal, which causes processor 118 to enter a phone mode. In one example, controller 104 controls sensors 122, 124, and 126 to detect proximity substantially simultaneously. In another example, controller 104 polls sensors 122, 124, and 126 sequentially. In still another example, controller 104 may control sensors 122, 124, and 126 to operate continuously, periodically, aperiodically, or in response to a triggering event.

In one instance, hearing aid 100 turns on when front sensor 122 and either left sensor 124 or right sensor 126 detect a proximity, and turns off at any other time. Thus, the hearing aid 100 can be configured to be responsive to proximities detected by at least two of the sensors 122, 124, and 126.

In another example, hearing aid 100 can be configured to change its state in response to a change in proximity detected by one of the sensors 122, 124, and 126. In one such example, front sensor 122 detects a front proximity, and hearing aid 100 is activated in response thereto. For such turn-on state functionality, front sensor 122 works well because of its location on the curved portion of the front side of casing 102, which is designed to rest on either the right side 212 or the left side 214, helping to prevent false positives, such as a false positive due to a counter top or table surface. For example, when a user positions hearing aid 100 on the ear, the front side of casing 102 comes into contact with the curvature of the back of the user's ear, and front sensor 122 detects the proximity of the user's head. However, when hearing aid 100 is placed on the table or desk for storage over night, casing 102 tends to rest on either the left side 214 or the right side 212 such that front sensor 122 is directed substantially parallel to a surface of the table. Accordingly, front sensor 122 does not detect a proximity of the surface on which it rests or at least produces a proximity signal that falls below a pre-determined threshold proximity. In this example, left sensor 124 and right sensor 126 may also be utilized to determine the ear to which the user has attached hearing aid 100 to help determine the operating mode of hearing aid 100.

In another instance, controller 104 may be configured to turn on after front sensor 122 detects proximity of an object (such as the back of the ear) for a specific period of time, an on-time, or at a specific distance, an on-distance. Alternatively, controller 104 may also be configured to turn hearing aid 100 off after front sensor 122 does not detect proximity of the object for a specific period of time, the off-time, or at a specific distance, the off-distance. For example, the hearing aid user may be running or jumping and hearing aid 100 may bounce on their head causing front sensor 122 to detect proximity at varying distance and/or lose the proximity signal altogether. In this instance, the off-time and off-distance can be set such that controller 104 does not turn off hearing aid 100 as front sensor 122 switches between detecting a proximity and not detecting a proximity. Also the on-time and the off-time may vary from each other. For example, the off-time may be greater than the on-time so that controller 104 waits longer before turning hearing aid 100 off than when turning hearing aid 100 on. Similarly, the off-distance may vary from the on-distance. For example, the on-distance may be set at a very close proximity, so that controller 104 only turns hearing aid 100 on when it is actually placed on an ear which the front surface is shaped to fit against and the off-distance may be set at a much larger distance, such that controller 104 only turns hearing aid 100 off when hearing aid 100 has been fully removed from the user's ear. It should be understood that an on-time, off-time, on-distance, and off-distance can be set for right and left sensor 124 and 126 as well as for front sensor 122, such that controller 104 may change the state and/or mode of hearing aid 100 based on the time and distance for which the front, left, and right sensors 122, 124, and 126 detect proximities.

While hearing aid 100 depicts front sensor 122, left sensor 124, and right sensor 126, any number and combination of sensors may be used. Further, while hearing aid 100 is described as a behind-the-ear type of hearing aid casing 102, other types of hearing aids may be used that employ sensors 122, 124, and 126 to detect the state and/or mode of the hearing aid. An example of a behind-the-ear hearing aid compatible with automatic mode/state change is described below with respect to FIG. 2.

Figure 2:
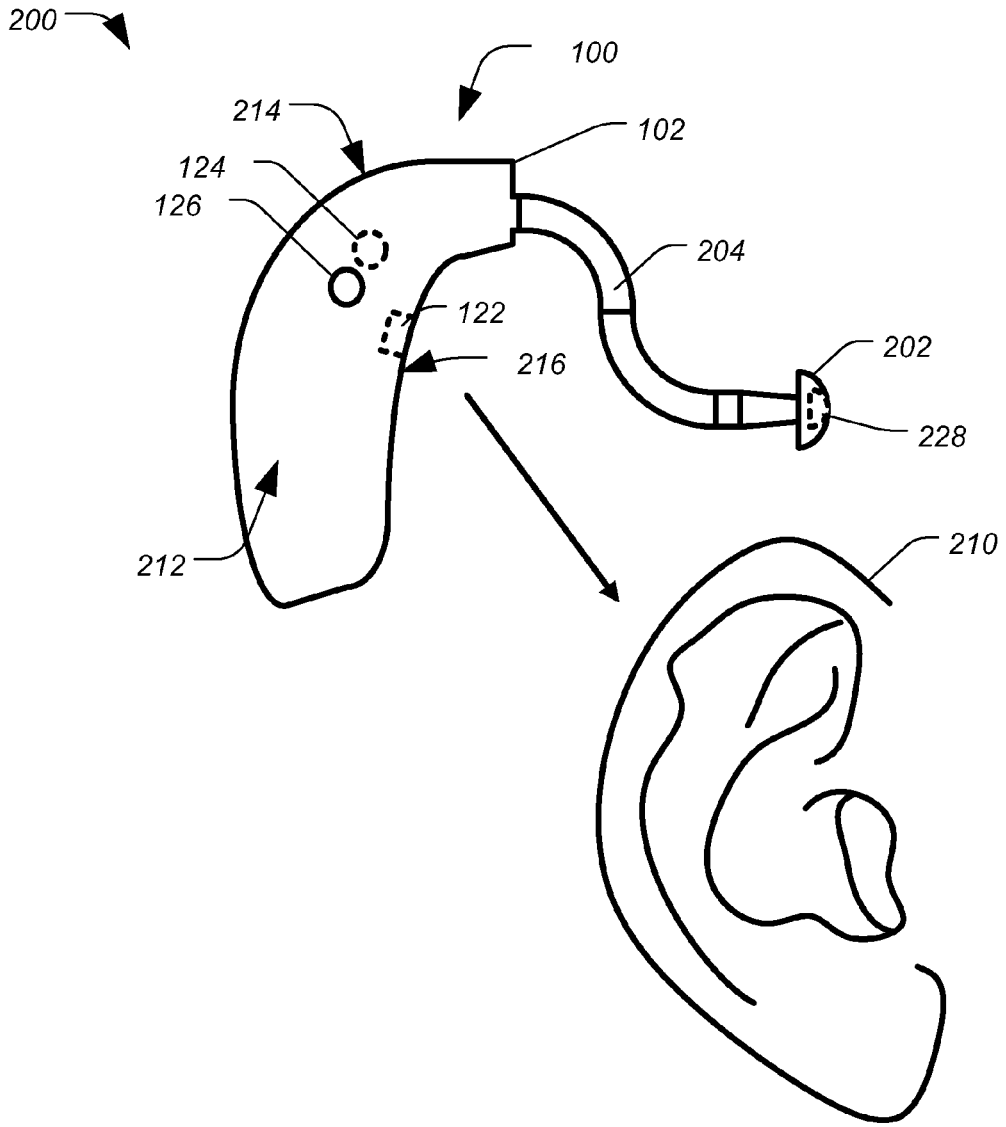
FIG. 2 is a perspective view of a user's ear and a partial cross-sectional view of an embodiment of the hearing aid of FIG. 1 including an in-ear sensor for detecting proximity.

FIG. 2 is a perspective view of a user's ear and a partial cross-sectional view 200 of hearing aid 100 in FIG. 1, including an in-ear sensor 228 for detecting proximity. Casing 102 of hearing aid 100 includes a right side 212, left side 214, and a front side 216, having corresponding right sensor 126, left sensor 124 (depicted in phantom because it is on the other side of casing 102), and front sensor 122, respectively. Hearing aid 100 includes an ear tube 204 connected to casing 102 on one end and to an ear bud 202 at another end. In one instance, ear tube 204 can be configured to transport acoustic signals from a speaker within casing 102 to ear bud 202. In another instance, ear tube 204 can include wires to carry electrical signals from a digital-to-analog converter within casing 102 to a speaker in ear bud 202.

Ear bud 202 includes an in-ear sensor 228, which is communicatively coupled to processor 118 within casing 102 via a wire (not shown) that extends through tube 204. In-ear sensor 228 is similar to sensors 122, 124, and 126 of FIG. 1 and is utilized to determine when the user has completed the insertion of ear bud 202 into the ear canal of ear 210 by detecting proximity of in-ear sensor 228 relative to the user's ear canal.

In this embodiment, hearing aid 100 fits on the user's right ear 210. Front sensor 122 and left sensor 124 detect the proximity of the user's ear and head, respectively, and controller 104 causes hearing aid 200 to turn on in response to detecting the proximity, and to enter the right ear mode based on the proximity signals from left sensor 124. In this example, controller 104 activates processor 118, which does not activate the speaker in ear bud 202 until in-ear sensor 228 detects proximity of the user's ear canal. When ear bud 202 is positioned within the ear canal of ear 210, in-ear sensor 228 generates a signal indicating proximity of the ear canal relative to the ear bud 202. Controller 104 causes hearing aid 100 to change to turn on, and processor 118 causes hearing aid 100 to enter the right ear mode. Further, processor 118 begins loading sound shaping instructions corresponding to right ear mode before activating speaker 108. By delaying turning on the speaker, processor 118 reduces noise caused by mechanical vibration of the speaker 108 and feedback during the insertion process.

FIGS. 1 and 2 depict a hearing aid including sensors for automating state and mode changes in a behind-the-ear hearing aid design. Other types of hearing aid designs may also utilize such proximity sensors for automatic state changes. While the above-discussion has focused on the circuitry that is configurable to provide the state change and mode change functionality, other circuits and structures may be used to implement the hearing aid with automatic mode change functionality. An example of one possible method of activating a hearing aid is described below with respect to FIG. 3.

Figure 3:
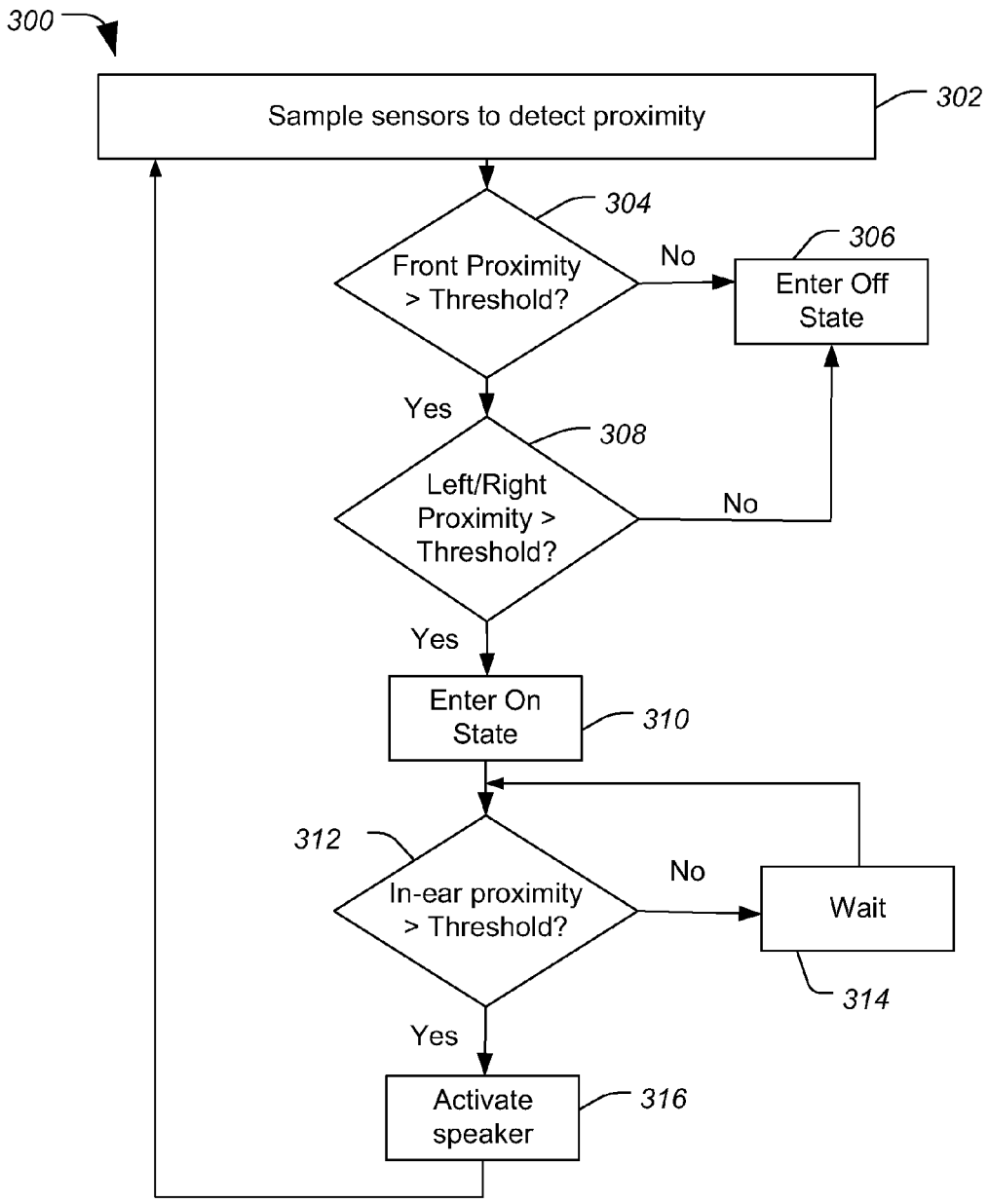
FIG. 3 is a flow diagram of an embodiment of a method of activating a hearing aid in response to detecting a proximity of a user's ear.

FIG. 3 is a flow diagram of an embodiment of a method 300 of activating a hearing aid in response to detecting proximity of a user's ear. At 302, controller 104 samples sensors to check for proximities. In one example, controller 104 applies a voltage to each of the sensors substantially simultaneously and monitors the return signals. In another example, controller 104 applies a voltage to each of the sensors sequentially and monitors the return signals. In still another example, controller applies a voltage to each of the sensors and monitors a current drawn by the sensor in response thereto. In an alternative example, the controller 104 applies a current and monitors a voltage.

Proceeding to 304, logic determines whether a front proximity (represented by a signal from the front sensor 122) exceeds a threshold proximity. The front proximity is represented by a signal that is proportional to proximity of an object relative to the front sensor 122. If the front proximity does not exceed the threshold proximity, the method 300 proceeds to 306 and the hearing aid enters or remains in the off state. If, at 304, the logic determines that the front proximity exceeds the threshold proximity, the method 300 proceeds to 308, and the controller 104 compares the proximity from the left and right sensors to a left/right proximity threshold. The left/right proximity may differ from the proximity threshold used to determine whether the front sensor 122 is proximate to the user's ear. If neither the right nor the left sensor proximity exceeds the left/right threshold, the method 300 proceeds to 306 and the hearing aid enters or remains in the off state. However, if either the right or the left sensor proximity exceeds the left/right threshold at 308, the method 300 proceeds to 310 and the hearing aid enters an on state. In one example, controller 104 generates a signal to activate processor 118, which activates other circuitry and which processes the left/right proximity signals to determine whether the hearing aid is in a left ear mode or a right ear mode. Processor 118 then loads the appropriate hearing aid profile for the left ear or the right ear for subsequently modulating sounds to compensate for the user's hearing deficiency.

Advancing to 312, processor 118 or controller 104 (depending on whether the in-ear sensor is connected to controller 104 or processor 118, for example, through an analog-to-digital converter) compares a proximity signal of in-ear sensor 228 to an in-ear threshold. If, at 312, the in-ear sensor proximity does not exceed the in-ear threshold, the method 300 proceeds to 314 and the controller 104 waits for a period of time. After the period of time elapses, the method 300 then returns to 312 and controller 104 compares the proximity from the in-ear sensor to the in-ear threshold. At 312, when the in-ear sensor proximity exceeds the in-ear threshold, the method advances to 316, and processor 118 activates the speaker 108. After activation of the speaker 108, the hearing aid 100 is in an on-state and is configured for the appropriate mode based on the detected ear.

In the above-discussion, it is assumed that the front sensor alone serves to determine the on-state of the hearing aid. However, it should be appreciated that all three sensors (front, right, and left) may be sampled to determine the on-state of the hearing aid. Further, once the hearing aid is configured and in an on-state, further automatic mode adjustments may be applied. For example, a sensor that is not pointing toward the back of the user's ear or toward the user's head may be free to detect proximity of a phone or other instrument. In some embodiments, controller 104 and processor 118 may utilize such detected proximity to adjust the operating mode of hearing aid 100.

Further, it should be appreciated that, during normal operation and as the user moves around, the hearing aid 100 may shift from time to time, for example, during rigorous exercise. To avoid undesired mode/state changes during such transient movements, the controller 104 may utilize ratios of proximities. Such ratios assume that the shift of two proximities will be somewhat proportional and/or that a difference between a measured ratio and a previously measured ratio will remain below a threshold level unless the hearing aid 100 is removed from the ear. Alternatively, the proximities may be averaged over a time window to prevent transient shifts from affecting the state/mode of the hearing aid 100.

While FIG. 3 shows one possible method of using sensors to control state changes such as on and off, it is also possible to determine the operating mode of the hearing aid, such as right ear mode, left ear mode, phone mode, or other modes using proximity sensors. One example of a method of using the sensors to determine and control mode changes is described below with respect to FIG. 4.

Figure 4:
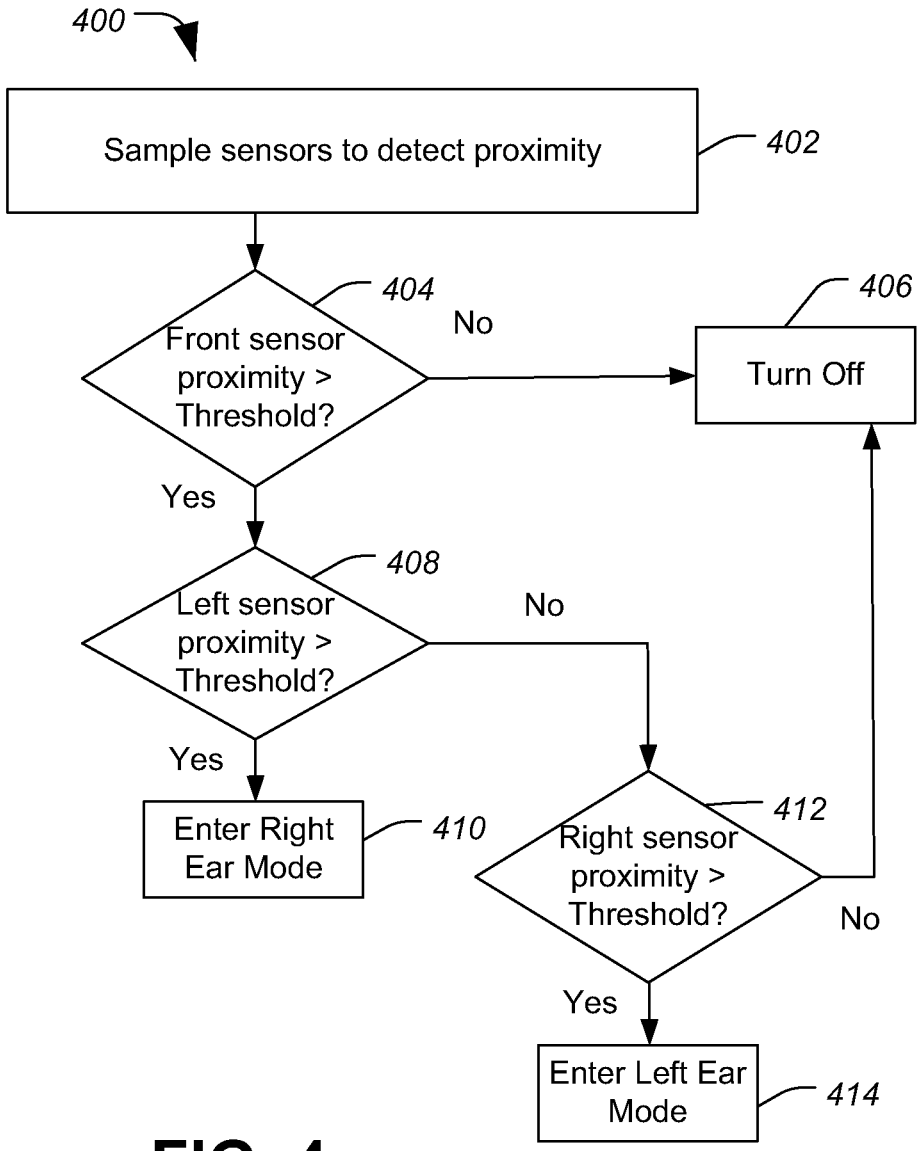
FIG. 4 is a flow diagram of an embodiment of a method of determining an operating mode of a hearing aid in response to detecting a proximity.

FIG. 4 is a flow diagram of an embodiment of a method 400 of determining an operating mode of a hearing aid in response to detecting proximity. At 402, controller 104 samples the proximity sensors to detect proximities. Proceeding to 404, if front sensor proximity does not exceed a front threshold, the method 400 proceeds to 406 and the controller 104 controls hearing aid 100 to turn off or to enter the off state. If the front sensor proximity exceeds the front threshold at 404, the method 400 proceeds to 408 and the controller 104 compares a left sensor proximity to a left threshold. At 408, if the left sensor proximity exceeds the threshold, the method 400 advances to 410 and the controller 104 controls processor 118 of hearing aid 100 to select a right ear mode. If, at 408, the left sensor proximity does not exceed the left threshold, the method 400 advances to 412.

At 412, if the right sensor proximity exceeds a right threshold, controller 104 controls processor 118 of hearing aid 100 to select a left ear mode. Otherwise, the method 400 proceeds to 406 and the hearing aid is turned off (or remains in an off-state). Alternatively, rather than proceeding to 406, controller 104 may maintain hearing aid 100 in a hold state until either the proximity of front sensor 122 or the proximities of left sensor 124 or right sensor 126 changes.

Methods 300 and 400 describe two of many possible methods of utilizing proximity sensors to trigger state/mode changes in a hearing aid. It should be understood that the order in which the blocks of methods 300 and 400 are performed may vary. For example, comparison of the left/right proximities at 408 and 412 may be reversed in terms of their order in method 400. Additionally it is also understood that some blocks of methods 300 and 400 may be combined or removed. For example, comparisons of left and right proximities at 408 and 412, respectively, may be combined. Further, with respect to the methods 300 and 400, new blocks can be added without departing from the scope of the disclosure.

In conjunction with the embodiments described above, a hearing aid is disclosed that includes a casing that is symmetrical and designed to fit either of the user's ears so that the user can position the hearing aid on either ear, as desired. The hearing aid includes multiple proximity sensors and a controller configured to determine proximity of the user (the user's ear and head) to the hearing aid. The controller cooperates with a processor of the hearing aid to turn on or turn off components based on the proximities and to select an operating mode based on the proximities. By providing a hearing aid with proximity sensors configured to select modes and determine state changes, the hearing aid can be designed to be interchangeable between the user's left and right ear and to automatically select the operating mode based on the selected ear. Thus, the hearing aid increases usability and reduces manufacturing and design costs. Additionally, by replacing mechanical switches with proximity sensors, the hearing aid can be sealed in from the elements, reducing exposure to dust and water and increasing operating life of the hearing aid.

Although the present invention has been described with reference to preferred embodiments, workers skilled in the art will recognize that changes may be made in form and detail without departing from the scope of the invention.

What is claimed is:

1. A hearing aid, comprising:

a casing configured to fit behind an ear of a user;

a proximity sensor configured to detect a proximity of an electronic device to the casing; and a processor configured to select between a normal operating mode and a direct input mode based at least in part on the detected proximity of the electronic device, the direct input mode including wirelessly receiving a signal representative of audio to be output by the hearing aid from the electronic device.

2. The hearing aid of claim 1, further comprising:

a second proximity sensor to detect a proximity of the user to the casing; and wherein the processor is configured to activate the hearing aid based at least in part on proximity of the user to the casing.

3. The hearing aid of claim 1, wherein the casing is configured to fit on either a right ear of the user or a left ear of the user.

4. The hearing aid of claim 1, wherein the normal operating mode includes at least one of a left ear mode and a right ear mode.

5. The hearing aid of claim 1, wherein the direct input mode is a phone mode.

6. The hearing aid of claim 1, wherein the direct input mode is a wireless mode.

7. The hearing aid of claim 1, wherein the direct input mode is a telecoil mode.

8. The hearing aid of claim 1, wherein the proximity sensor is configured to detect the proximity of the electronic device by:

generating a proximity signal that is indicative of a distance between the electronic device and the casing; and comparing the signal to a threshold distance.

* * * * *